US005328115A

United States Patent [19]

Samuelson et al.

[11] Patent Number: 5,328,115

[45] Date of Patent: Jul. 12, 1994

[54] REFILLABLE TAPE DISPENSER WITH HUB

[75] Inventors: Bruce E. Samuelson, Stillwater; Carol L.-E. Smith, Maple Grove; Gary A. Albrecht, New Brighton; Winston E. Pagel, Woodbury, all of Minn.

[73] Assignee: Minnesota Mining and Manufacturing Company, St. Paul, Minn.

[21] Appl. No.: 734,517

[22] Filed: Jul. 23, 1991

Related U.S. Application Data

[63] Continuation-in-part of Ser. No. 589,067, Sep. 27, 1990, Pat. No. 5,083,717.

[51] Int. Cl.[5] ..... B65H 19/00

[52] U.S. Cl. ..... 242/588.6; 206/411; 403/289

[58] Field of Search ..... 242/55.2, 55.3, 55.42, 242/55.53, 55.54, 118.41; 206/411; 225/42, 47, 48, 49; 40/309; 403/289, 381, 375

[56] References Cited

U.S. PATENT DOCUMENTS

| | | | |
|---|---|---|---|
| D. 144,215 | 3/1946 | Preble, Jr. | D74/1 |
| D. 170,429 | 9/1953 | Reinecke | D74/1 |
| D. 250,338 | 11/1978 | LaPierre | 242/118.41 |
| 1,825,822 | 10/1931 | Rundell | 242/55.2 |
| 2,171,648 | 9/1939 | Ennis et al. | 242/55.2 |
| 2,264,425 | 12/1941 | Witter | 164/84.5 |
| 2,275,408 | 3/1942 | Alliss | 242/55.2 |
| 2,529,420 | 11/1950 | Ramquist | 242/55.2 |
| 2,693,918 | 11/1954 | Bretson et al. | 242/55.5 |
| 2,772,774 | 12/1956 | Rabuse | 206/59 |
| 3,086,309 | 4/1963 | Katz | 40/309 |
| 3,700,151 | 10/1972 | Youngstrom | 225/26 |
| 4,235,389 | 11/1980 | Ness | 242/55.2 |
| 4,627,560 | 12/1986 | Samuelson | 225/66 |
| 4,729,518 | 3/1988 | Mathna et al. | 242/55.53 |
| 4,732,271 | 3/1988 | Solyntjes | 242/55.53 |
| 4,915,769 | 4/1990 | Heil et al. | 156/527 |
| 4,928,864 | 5/1990 | Walker et al. | 225/66 |
| 5,083,717 | 1/1992 | Samuelson et al. | 242/55.53 |

FOREIGN PATENT DOCUMENTS

| | | |
|---|---|---|
| 256387 | 2/1988 | European Pat. Off. . |
| 958631 | 1/1957 | Fed. Rep. of Germany . |

OTHER PUBLICATIONS

Foreign Reference 571,045.

*Primary Examiner*—Daniel P. Stodola
*Assistant Examiner*—John Q. Nguyen
*Attorney, Agent, or Firm*—Gary L. Griswold; Walter N. Kirn; Jeffrey J. Hohenshell

[57] ABSTRACT

A refillable tape dispenser comprising a housing including a side wall, and a hub having a longitudinal axis defining an axial direction. The hub has inner and outer surfaces, and a first end fixed to the side wall. The hub comprises first and second opposed flexible portions having distal ends remote from the side wall which flexible portions project axially from the side wall. The dispenser also includes a retaining lug at the distal end of each of the flexible portions. The retaining lugs have remote ends spaced axially from the flexible portions. Ribs are present at the distal end of each of the flexible portions. The ribs project radially outward of the flexible portions and have axially extending arcuate bearing surfaces. The dispenser of the present invention is particularly suitable for coupling to a backcard having chevron-shaped openings.

8 Claims, 6 Drawing Sheets

Fig. 13
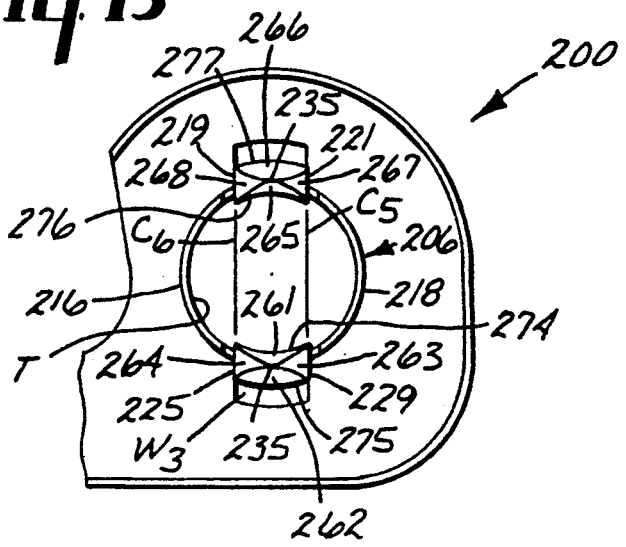
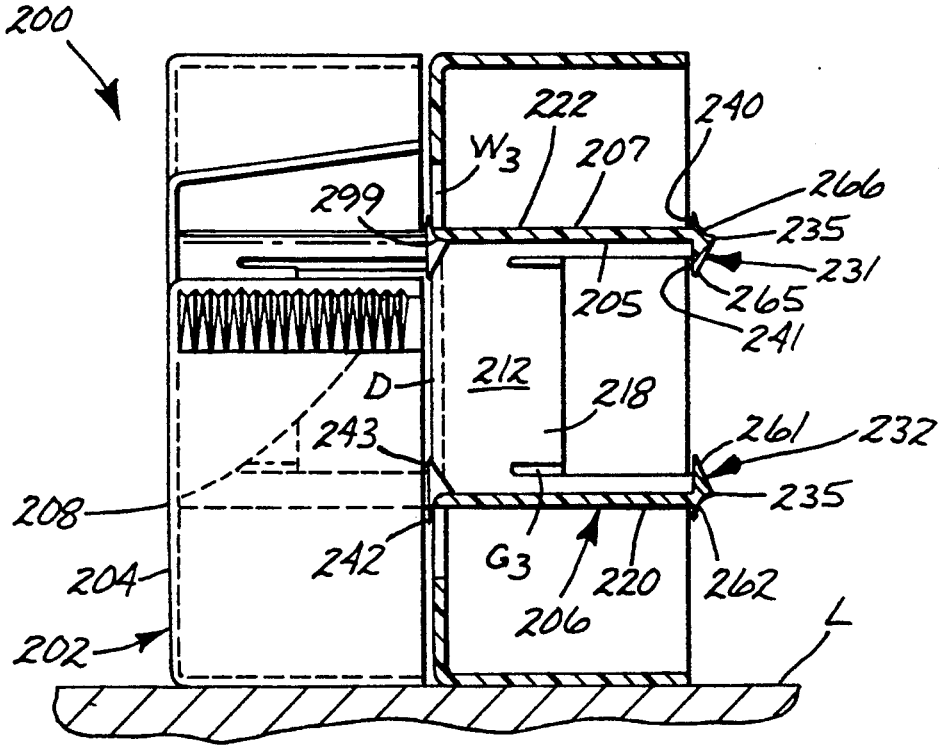
Fig. 14

Fig. 15
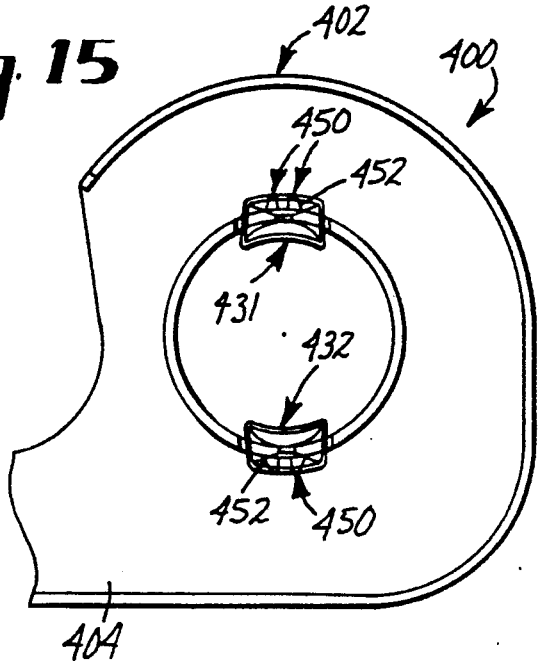
Fig. 16
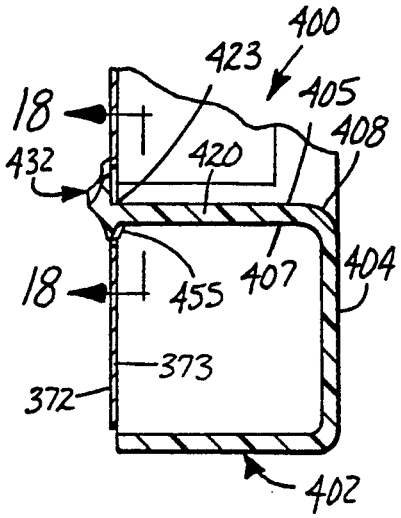
Fig. 17
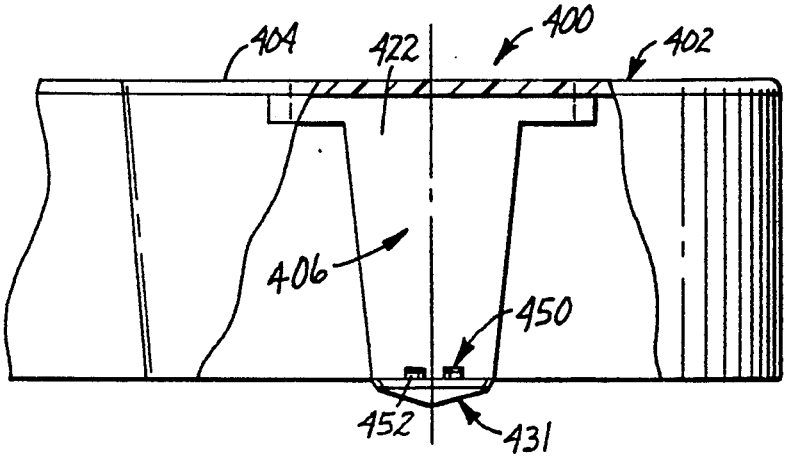
Fig. 19
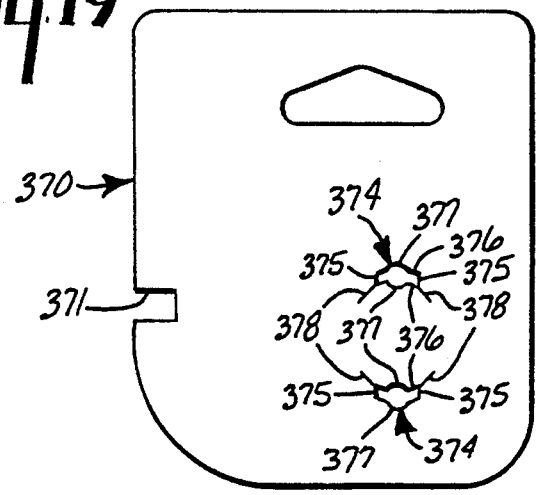
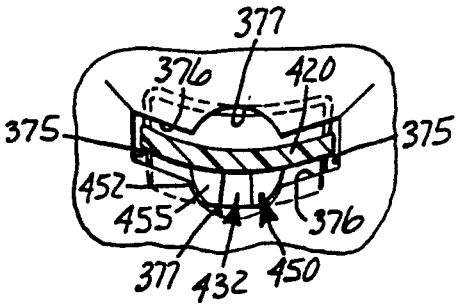
Fig. 18

REFILLABLE TAPE DISPENSER WITH HUB

CROSS REFERENCE TO RELATED APPLICATION

This application is a continuation-in-part of application Ser. No. 07/589,067 filed Sep. 27, 1990, now U.S. Pat. No. 5,083,717; the entire contents of which are herein expressly incorporated by reference.

TECHNICAL FIELD

The present invention relates to hand held tape dispensers for disbursing a supply of adhesive coated tape and associated backcards for hanging the dispensers on a commercial display.

BACKGROUND

The art is replete with dispensers including a polymeric housing including a hub, a roll of tape including a core journaled on the hub and a length of pressure sensitive adhesive coated tape helically wound around the core, and a paper backcard attached at one end of the hub by which the dispenser can be hung on a display shelf or rack. The backcard is disposed around one end of the hub with the hub disposed within a through opening in the core and a portion of the backcard adjacent one side surface of the roll of tape.

In a known non-reuseable type dispenser, the backcard is held adjacent one side surface of the roll of tape and the roll of tape is prevented from sliding axially off the cylindrical outer surface of the hub by a series of tabs integral with the hub and formed by heat sealing or ultrasonically welding the tabs in a position projecting generally perpendicular to a longitudinal axis of the hub. While the backcard is reliably attached to the dispenser, the heat sealing or ultrasonic processes used to form the tabs are irreversible and thus result in a product which is non-reuseable and non-refillable. Also, the heat sealing process used to form the tabs requires time during the manufacturing process which increases the time needed to manufacture a dispenser.

Non-reuseable dispensers are associated with environmental problems, such as problems related with disposal of spent dispensers. Many hand held tape dispensers are manufactured from polystyrene which has a relatively slow degeneration rate. These types of dispensers are used until the roll of tape is depleted and then disposed.

FIGS. 1 and 2 are illustrations of existing tape dispensers which can be re-used. The dispenser 10 depicted in FIG. 1 is a SCOTCH brand transparent tape dispenser available from 3M Argentina. The dispenser 50 of FIGS. 2 and 2A is a NICHIBAN double sided tape dispenser available from Nichiban of Japan which has many parts that are essentially the same as the parts of the dispenser 10 and which have been identified by the same reference numeral to which has been added the suffix "A". Each dispenser 10, 50 includes a housing 20, 20A including a side wall 21, 21A, and a tubular hub 22, 22A having cylindrical inner 23, 23A and outer 24, 24A surfaces, and a first end 25A (FIG. 2A) fixed to the side wall 21, 21A. The hub 22, 22A comprises a base portion 26A joined to the side wall 21, 21A opposite arcuate guide portions 27, 27A projecting axially from the base portion 26A, and first 28, 28A and second 29, 29A opposed arcuate arm portions having a distal end 30, 30A remote from the base portion 26A. The first 28, 28A and second 29, 29A arm portions project axially from the base portion 26A between the guide portions 27, 27A.

The distal ends 30, 30A of the arm portions 28, 28A, 29, 29A include planar cam surfaces 31, 31A and lips 32, 32A; 33, 33A extending radially outward from the hub adjacent the planar cam surface 31, 31A and each of the arm portions 28, 28A, 29, 29A further have arcuate or sloping edges 34, 35, 36, 37; 34A, 35A, 36A, 37A adjacent their distal ends 30, 30A which are located at the edges of the planar cam surfaces 31, 31A. The dispenser 50 shown in FIG. 2 includes an axially extending rib 51A that is believed to assist the hub 22A in holding the backcard 41A on the dispenser 50.

FIGS. 7 and 7A show typical backcards 40, 40A used with the dispensers 10, 50 of FIGS. 1, 2 and 2A which include a hanging aperture 41, 41A adapted to afford display of the dispenser 10, 50, and through openings 42, 42A, 43, 43A disposed between an outer portion of the dispenser housing 49, 49A and the lips 32, 32A, 33, 33A of the hub 22, 22A. The backcard 40 of FIG. 7 is used in conjunction with the dispenser 10 shown in FIG. 1, and comprises cuts 44 and 45 which extend radially away from the through openings 42, 43. The cuts 44, 45 are adapted to permit flexing of the backcard 40 to afford passage of the cam surfaces 31 and lips 32, 33 of the hub 22 through the openings 42, 43 from one side of the backcard 40 to the other during joining of the backcard to the dispenser.

The backcard 40A illustrated in FIG. 7A is used in conjunction with the dispenser 50 shown in FIG. 2. Unlike the guide portions 27 of the dispenser 10, the guide portions 27A of the dispenser 50 extend axially beyond the outer portion 49A of the dispenser housing and fit into large arcuate holes 52A in the backcard 40A (FIG. 2A). This feature is believed to assist in retaining the backcard upon the hub 22A.

During the manufacturing and assembly processes, the dispensers 10, 50 described in FIGS. 1, 2 and 2A, encounter problems when they are joined to the backcards 40, 40A. To join the backcards 40, 40A to the dispensers 10, 50, the cam surfaces 31, 31A and lips 32, 32A, 33, 33A of the hubs 22, 22A must penetrate the openings 42, 42A, 43, 43A of the backcards 40, 40A. The planar cam surfaces 31, 31A and the distal ends 30, 30A of the arm portions present blunt surfaces which are not readily adapted to penetrate the through openings 42, 42A, 43, 43A of the backcards 40, 40A. A failure to join the backcard to the dispenser may result in undesirable consequences such as an increase in the number of rejected dispensers on an assembly line. Such a result may also cause an accumulation or pile-up of dispensers on an assembly line of a high speed assembler which tends to cause assembler failure.

The dispensers disclosed in FIGS. 1, 2 and 2A also encounter problems with retaining the backcards 40, 40A between the lips 32, 32A, 33, 33A and the outer portion 49, 49A of the dispenser housing 20, 20A. The hand held dispensers 10, 50 are subject to a variety of loads such as torque, vibration and shock loads, which can cause the backcards 40, 40A to separate from the hubs 22, 22A. This is an undesirable result for the user as the user must manually replace the backcards in order to hang the dispenser on a commercial display. One solution to this problem has been to place a length of adhesive coated tape across the backcard 40, 40A and the camming surface 31, 31A. This solution, however, is expensive and requires at least one additional step during the manufacturing process.

Also, backcards which utilize through openings with "square" edges or edges formed by the intersection of two straight members tend to tear at the intersection of the two straight member, particularly when the dispenser and backcard are dropped. Stress is believed to be concentrated at the intersection of the two straight members which tends to cause the backcard to tear at the intersection. Such tearing of the backcard tends to lead to backcard rotation and backcard separation from the dispenser. Excessive backcard rotation adversely affects the product's presentation to the consumer, and backcard separation requires extra effort by the user as the backcard must again be attached to the dispenser before the dispenser may be displayed on a commercial display rack.

DISCLOSURE OF THE INVENTION

The present invention provides a refillable hand held tape dispenser for a roll of adhesive tape having a hub portion which is particularly suitable for joining the dispenser to a backcard, which restricts backcard rotation, which is capable of securely holding the backcard to the dispenser, which releasably holds a core and a roll of tape within the dispenser, and which is readily adapted to be assembled using high speed assembly machinery.

According to the present invention there is provided a refillable tape dispenser comprising a housing including a side wall, and a tubular hub having a longitudinal axis defining an axial direction, and a first end fixed to the side wall. At the junction between the inner surfaces of the first end of the hub and the side wall there are surfaces defining a convex arcuate portion. The hub comprises a continuous base portion joined to the side wall, first and second opposed arcuate guide portions which project axially from the continuous base portion, and first and second opposed arcuate flexible portions which have distal ends remote from the continuous base portion. The first and second flexible portions each project axially from the continuous base portion between the guide portions, and each of the flexible portions have axially extending side surfaces defining non-diametrical chords for the cylindrical hub.

Each of the first and second flexible portions have a retaining lug at their distal ends. The retaining lugs each have a first retaining surface adjacent the distal end of the flexible portion projecting radially outward of the flexible portion and having an outer edge, and a second retaining surface also adjacent the distal end of the flexible portion projecting radially inward of the flexible portion and having an inner edge. The retaining lugs further have cam surfaces diverging from the remote end of the retaining lugs toward the first and second retaining surfaces.

In a first embodiment of a dispenser according to the present invention, the retaining lugs each comprise first and second camming surfaces diverging from the remote end of the retaining lugs toward the outer edges of the first retaining surfaces and the inner edges of the second retaining surfaces of the retaining lugs, and third and fourth camming surfaces diverging from the remote end of the retaining lugs toward the axially extending side surfaces defining the non-diametrical chords for the hub.

The dispensers according to the present invention are adapted to have a backcard disposed around the distal ends of the first and second opposed arcuate flexible portions. The backcard has opposite major surfaces and edge surfaces between the major surfaces defining first and second chevron-shaped openings between the major surfaces. The edge surfaces define each of the openings and include generally parallel end surface portions, two pairs of opposite parallel surface portions disposed at obtuse angles with respect to each other and defining outer portions of the openings, and concave arcuate surface portions joining the pairs of opposite parallel surface portions to each other and defining generally circular central portions of the openings.

In a second embodiment of a dispenser according to the present invention, the retaining lugs each have first and second camming surfaces diverging from the remote end of the retaining lug toward the outer edges of the first retaining surfaces and the inner edges of the second retaining surfaces of the retaining lugs, and side edge surfaces extending generally perpendicular to the first and second retaining surfaces of the retaining lugs and co-planar with a corresponding one of the axial extending side surfaces defining non-diametrical chords for the hub.

In a third embodiment of a dispenser according to the present invention, the retaining lugs each have at least first and second camming surfaces diverging from the remote end of the retaining lug toward the outer edges of the first retaining surfaces and the inner edges of the second retaining surfaces of the retaining lugs, as in the first and second embodiments. However, in the third embodiment of dispenser according to the present invention, the first camming surfaces are arcuate concave surfaces having a diameter between middle portions of the first camming surfaces generally equal to a diameter of middle portions of the convex arcuate portion of the housing to afford engagement with the convex arcuate portion of the housing of a second dispenser to maintain the relative positions of the tape dispensers when, for example, the dispensers traverse an assembly line.

According to a fourth embodiment of dispenser according to the present invention, there is provided a refillable tape dispenser comprising a housing including a side wall, and a hub. Like the previously mentioned dispensers, the hub has a longitudinal axis defining an axial direction, inner and outer surfaces, and a first end fixed to the side wall. The hub also comprises first and second opposed flexible portions having distal ends remote from the side wall. The first and second opposed flexible portions project axially from the side wall. A retaining lug is located at the distal end of each of the flexible portions.

Unlike the previously mentioned embodiments of the present invention, the dispenser according to the fourth embodiment comprises ribs located at the distal end of each of the flexible portions. The ribs project radially outward of the flexible portions and have axially extending arcuate bearing surfaces. The arcuate surface portions of the backcard are positioned generally adjacent the bearing surfaces of the ribs so that the surface area of the dispenser which impacts the surfaces defining the chevron-shaped openings is increased to thereby restrict the damage to the backcard particularly at the intersection between an end surface portion and an opposite parallel surface portion. Additionally, the bearing surfaces act as a barrier to restrict backcard rotation.

Optionally, the ribs may be fixed to the retaining lug. Also optionally, the ribs may include ramp surfaces opposite the retaining lug disposed at an angle adapted to cam the flexible portions radially inwardly when the core of a roll of tape is removed from the hub. Such ramp surfaces assist a user in removing a core of tape from the dispenser.

BRIEF DESCRIPTION OF THE DRAWING

The present invention will be further described with reference to the accompanying drawing wherein like reference numerals refer to like parts in the several views, and wherein:

FIG. 13 is a side view of a third embodiment of dispenser according to the present invention having portions broken away to show detail;

FIG. 14 is a partially broken away enlarged side view of a pair of dispensers according to the third embodiment of the present invention illustrating the relative positions of the dispensers along an assembly line;

FIG. 15 is a side view of a fourth embodiment of dispenser according to the present invention having portions broken away to show detail;

FIG. 16 is an enlarged sectional view of the dispenser of FIG. 15 coupled to a backcard and having portions broken away to feature details;

FIG. 17 is an enlarged top view of the dispenser of FIG. 15 having portions broken away to illustrate detail;

FIG. 18 is a sectional view taken approximately along line 18—18 of FIG. 16; and FIG. 19 is a side view of a fourth embodiment of backcard for a dispenser according to the present invention which is particularly suited for the dispenser shown in FIG. 15.

DETAILED DESCRIPTION

Figure 1:
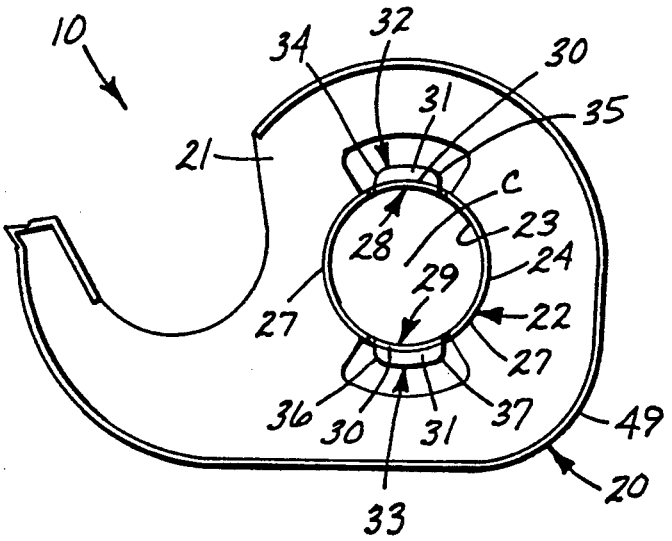
Fig. 1 PRIOR ART
FIG. 1 is a side view of a first prior art dispenser.

Referring now to FIGS. 3, 4, 11 and 12 of the drawing there is shown a first embodiment of dispenser 100 according to the present invention with a roll of tape 1 comprising a core 2 (FIG. 4) having inner 3 and outer 4 cylindrical surfaces and a through opening 5 defined by the cylindrical inner surface, and a length of pressure sensitive adhesive coated tape 6 helically wound around the core 2.

The refillable tape dispenser 100 comprises a housing 102 including a side wall 104, and a tubular hub 106 having a longitudinal axis A defining an axial direction, cylindrical inner 105 and outer 107 surfaces, and a first end 108 adjacent the side wall 104. At the junction between the inner surface 105 of the hub 106 and the side wall 104 is a convex arcuate portion 199.

The hub 106 comprises a continuous base portion 112 joined to the side wall 104 by being integral therewith, first 116 and second 118 opposed arcuate guide portions projecting axially from the continuous base portion 112, and first 120 and second 122 opposed arcuate flexible portions having a distal end 123 remote from the continuous base portion 112. The first 120 and second 122 opposed arcuate flexible portions project axially from the continuous base portion 112 between the guide portions 116, 118 and have axially extending side surfaces 119, 121, 125, 129 defining non-diametrical chords C1 and C2 for the hub 106.

Figure 11:
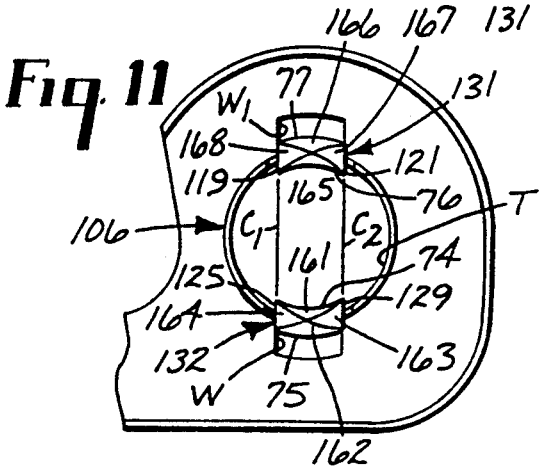
FIG. 11 is a side view of the first embodiment of dispenser according to the present invention having portions broken away to show detail.
Figure 7A:
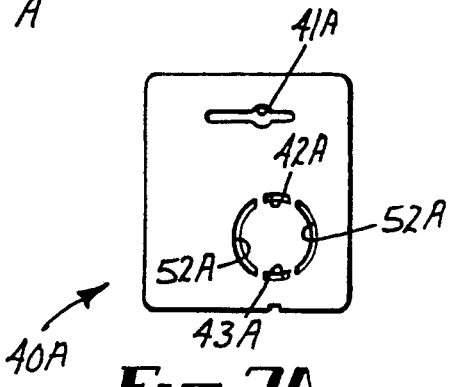
Fig. 7A PRIOR ART
FIG. 7A is a reduced side view of a prior art backcard for use with the prior art dispenser of FIG. 2.

In this application, the phrase "non-diametrical chords" refers to the geometry and locations of the surfaces 119, 121, 125, 129 (FIG. 11). Generally, in the present invention, a line cannot be drawn between points on at least two of the axially extending side surfaces 119, 121, 125, 129 which both passes through a center of the hub 106 and which remains parallel to at least two of the axially extending side surfaces 119, 121, 125, 129. Thus, the axially extending side surfaces 119, 121, 125, 129 are referred to as forming non-diametrical chords for the hub 106.

Figure 2:
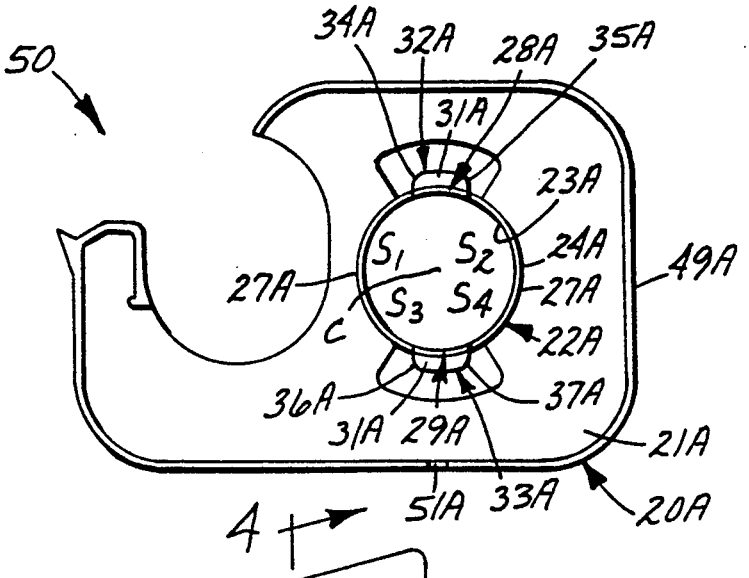
Fig. 2 PRIOR ART
FIG. 2 is a side view of a second prior art dispenser.

In contrast, in some prior art dispensers, a line drawn between opposite side surfaces of different arm portions (such as S1 and S4 in FIG. 2) approximates a diametrical chord as opposite surfaces which are disposed along the same arm portion (S1 and S2 for example) converge toward the center C of the hub. Opposite surfaces which are located on the same arm portion (such as S3 and S4) are not parallel with each other and end in an arcuate or sloping edges 34, 35, 36, 37; 34A, 35A, 36A, 37A.

The housing 102 of the dispenser 100 includes a retaining lug 131, 132 at the distal end 123 of each of the flexible portions 120, 122 and the retaining lugs 131, 132 have a remote end 135 spaced axially from the flexible portions 120, 122. At the proximal end of the retaining lugs 131, 132 (or the distal end 123 of the flexible portions 120, 122), there are present first retaining surfaces 140, 142 adjacent the flexible portions 120, 122 which project radially outward of the flexible portions 120, 122 to outer edges 75, 77 and second retaining surfaces 141, 143 adjacent the flexible portions 120, 122, which project radially inward of the flexible portions 120, 122 to inner edges 74, 76.

According to a first embodiment of the present invention shown in FIGS. 3, 4, 11 and 12, the retaining lugs each include first and second camming surfaces 161, 162, 165, 166 which diverge from the remote ends 135 of the retaining lugs 131, 132 toward the outer edges 75, 77 of first retaining surfaces 140, 142 and the inner edges 74, 76 of the second retaining surfaces 141, 143. Each of the lugs 131, 132 also include third and fourth camming surfaces 163, 167, 164, 168 which diverge from the remote end 135 of the retaining lugs 131, 132 toward the axially extending side surfaces 119, 121, 125, 129 defining the non-diametrical chords C1, C2 (FIG. 11) for the hub 106. The cam surfaces form a relatively sharp edge at the remote end 135 of the retaining lugs 131, 132 which affords efficient coupling of the dispenser 100 to a backcard.

In comparison to the blunt end surfaces of the prior art dispensers, the relatively sharp edges at the remote ends 135 of the retaining lugs 131, 132 of the present invention are particularly well adapted to pierce a hole in a backcard and thereby afford efficient assembly using high speed assembly machinery.

The first retaining surfaces 140, 142 of the retaining lugs 131, 132 assist in retaining the core 2 journaled on the outer surface 107 of the hub 106 by restricting axial movement of the core 2 relative to undeflected first and second flexible portions 120, 122, since in an undeflected position, the radius of the radially outermost portion 75, 77 of the first retaining surfaces 140, 142 is larger than the inner radius 3 of the core 2.

The first retaining surfaces 140, 142 also combine with the second retaining surfaces 141, 143 to prevent backcard separation from the dispenser 100. While the prior art dispensers have the capacity to be refilled, the radially outward extending lips 32, 32A; 33, 33A and arcuate or sloping edges 34, 35, 36, 37; 34A, 35A, 36A, 37A encounter difficulties in maintaining the backcard coupled to the dispensers 10, 50. It is believed that one mode of failure for the prior art dispensers is that the backcards 40, 40A tend to lap over the distal ends of the lips 32, 32A, 33, 33A and thereafter separate from the hubs 22, 22A. The rounded or sloping edges 34, 35, 36, 37, 34A, 35A, 36A, 37A combined with the uniform width of backcard holes 42, 42A, 43, 43A tend to allow the backcard to lap over the distal end of the lips 32, 32A, 33, 33A.

Figure 4:
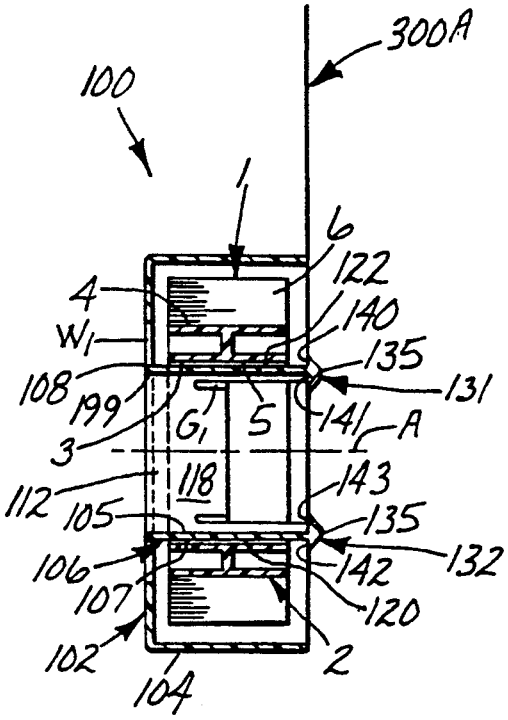
FIG. 4 is a sectional view taken approximately along line 4—4 of FIG. 3.

In contrast the axially extending side surfaces 119, 121, 125, 129 of the flexible portions 120, 122 of the present invention abruptly end in edges E (FIG. 12) to provide a barrier that prevents the backcard from lapping over the lugs 131, 132. Also, as shown in FIG. 4, the first and second retaining surfaces 140, 141, 142, 143 of the present invention extend both radially outward and radially inward of a hole (320A, FIG. 8 for example) in a backcard to further deter the backcard from lapping over the retaining lugs 131, 132 and thereafter separating from the hub 106.

Figure 12:
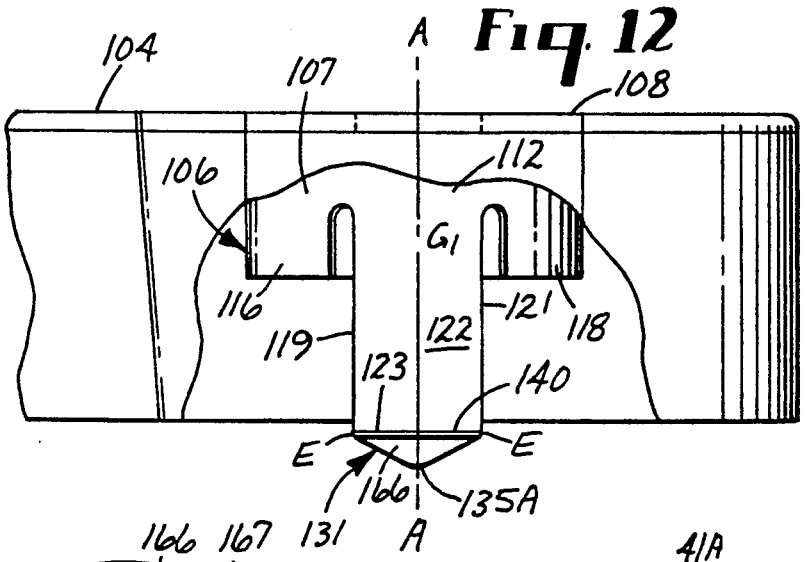
FIG. 12 is an enlarged top view of the dispenser of FIG. 11 having portions broken away to illustrate detail.

The edges E (FIG. 12) of the present invention are an important feature for preventing backcard separation from the dispenser. The hub 106 for the dispenser 100 comprises axially extending side surfaces 119, 121, 125, 129 defining non-diametrical chords for the hub 106. The surfaces 119, 121, 125, 129 are parallel to each other and are generally perpendicular to the first and second retaining surfaces 140, 142. As shown in FIG. 12, the surfaces 119, 121, 125, 129 come to an abrupt end at the edge E of the retaining lugs 131, 132. When the backcard 300A (FIG. 8) is attached to the dispenser, an end surface 301A of a hole in the backcard is proximate the surfaces 119, 121, 125, 129. The side surfaces 119, 121, 125, 129 and the retaining surfaces 140, 141, 142, 143 function to hold the backcard onto the dispenser and deter the end surface 301A from lapping over the lugs 131, 132 and thereafter separating from the dispenser.

To replace a depleted roll of tape 1, a user manually deflects the flexible portions 120, 122 radially inward to afford passage of the inner cylindrical surface 3 of the depleted core. Preferably, the dispenser 100 comprises a unitary construction of a flexible material. A material that is particularly adapted for construction of the dispenser 100 is Polystyrene which affords sufficient flexing of the flexible portions 120, 122 to permit axial passage of the inner cylindrical surface 3 of the core 2 of the depleted and replacement tape rolls. The material comprising the flexible portions 120, 122 should have the capacity to deflect without breaking or cracking. Polystyrene has a modulus of elasticity of between 100,000 and 300,000 psi (pounds per square inch) which provides flexible portions 120, 122 with an appropriate spring constant. However, any suitable material or combination of materials that affords sufficient flexing of the flexible portions 120, 122 without cracking or breaking may be used to construct the dispenser. The length of the groove G1 between the guide portions 116, 118 and the flexible portions 120, 122 may also be manipulated to control the flexibility of the flexible portions 120, 122.

Figure 5:
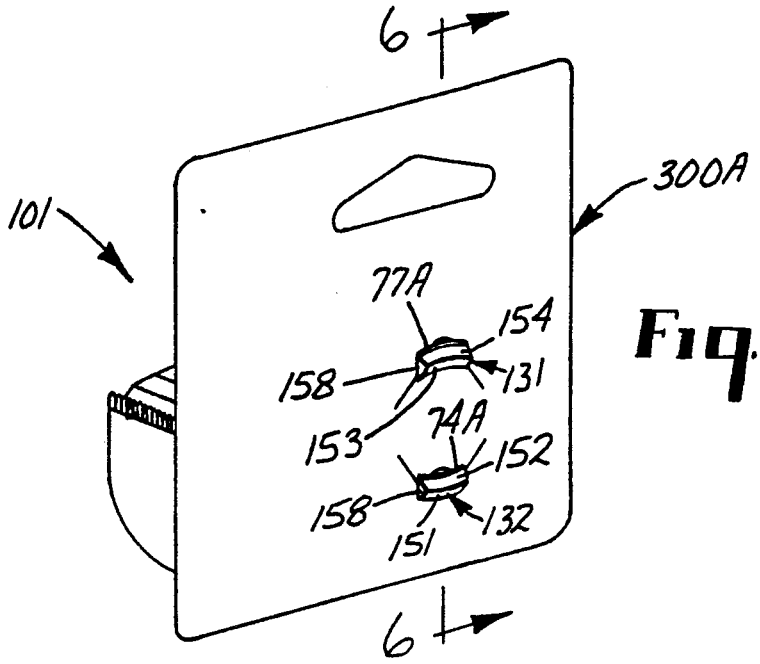
FIG. 5 is a perspective view of a second embodiment of dispenser according to the present invention illustrating the dispenser coupled to a backcard.
Figure 6:
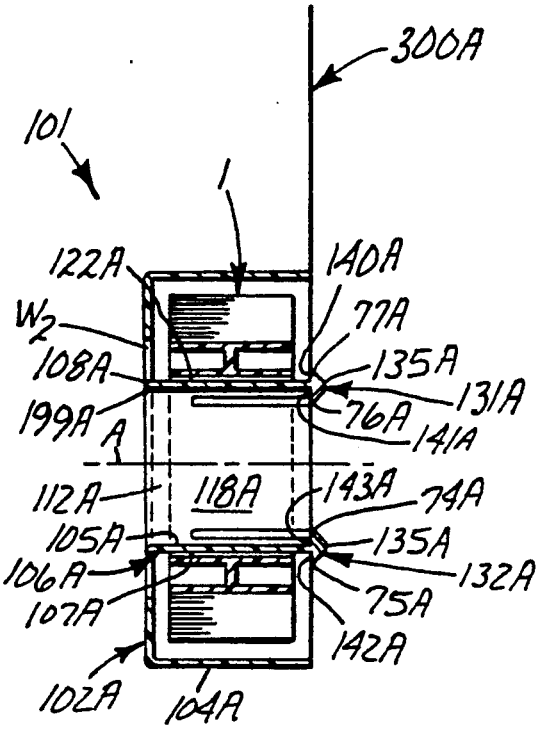
FIG. 6 is a sectional view taken approximately along line 6—6 of FIG. 5.
Figure 7:
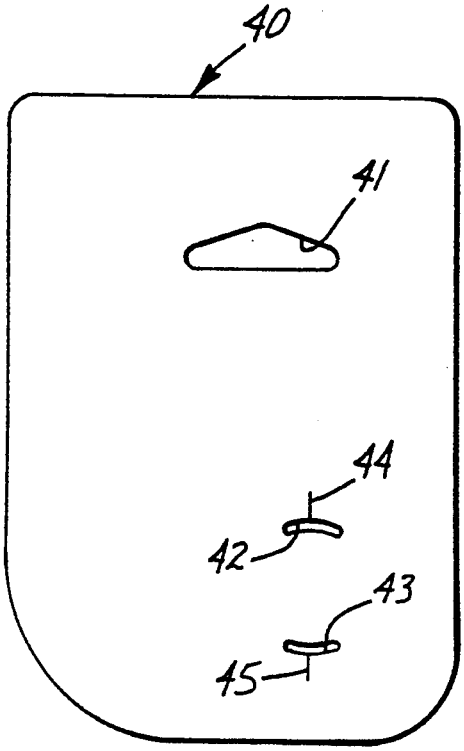
Fig. 7 PRIOR ART
FIG. 7 is a side view of a prior art backcard for use with the prior art dispenser of FIG. 1.

FIGS. 5 and 6 illustrate a second embodiment of a dispenser according to the present invention generally designated by the reference number 101 which has many parts that are essentially the same as the parts of the dispenser 100 and which have been identified by the same reference numeral to which has been added the suffix "A". Like the dispenser 100, the dispenser 100A comprises a housing 102A including a side wall 104A, and a tubular hub 106A having a longitudinal axis A defining an axial direction, cylindrical inner 105A and outer 107A surfaces, and a first end 108A fixed to the side wall 104A. At the junction between the inner surface 105A of the hub 106A and the side wall 104A is a convex arcuate portion 199A.

The hub 106A comprises a continuous base portion 112A joined to the side wall 104A by being integral therewith, first 116A and second 118A opposed arcuate guide portions projecting axially from the continuous base portion 112A, and first 120A and second 122A opposed arcuate flexible portions having a distal end 123A remote from the continuous base portion 112A. The first 120A and second 122A flexible portions project axially from the continuous base portion 112A between the guide portions 116A and 118A and have axially extending side surfaces (similar to surfaces 119, 121, 125, 129 of the first embodiment of the present invention) defining non-diametrical chords (not shown) for the hub 106A.

Like the dispenser 100, the dispenser 101 also comprises retaining lugs 131A, 132A at the distal ends 123A of each of the flexible portions 120A, 122A and the retaining lugs 131A, 132A have a remote end 135A spaced axially from the flexible portions 120A, 122A. At a proximal end of each of the retaining lugs 131A, 132A (or the distal end 123A of the flexible portions), there is present first retaining surfaces 140A, 142A which project radially outward of the flexible portions 120A, 122A and have outer edges 75A, 77A, and second retaining surfaces 141A, 143A which project radially inward of the flexible portions 120A, 122A and have inner edges 74A, 76A. The retaining lugs 131A, 132A each comprise first 151, 154 and second 152, 153 camming surfaces diverging from the remote end 135A of the retaining lugs 131A, 132A toward the outer edges 75A, 77A of the first retaining surfaces 140A, 142A and the inner edges 74A, 76A of the second retaining surfaces 141A, 143A. For example, the cam surfaces 153, 154 of retaining lug 131A diverge toward the outer edge 77A of the first retaining surface 140A and the inner edge 76A of the second retaining surface 141A.

In contrast to the dispenser 100, the embodiment of the present invention shown in FIGS. 5 and 6 includes side edge surfaces 158 extending generally perpendicular to the first and second retaining surfaces 140A, 141A, 142A, 143A of the retaining lugs 131A, 132A and co-planar with a corresponding one of the axial extending side surfaces (not shown but similar to 119, 121, 125, 129 of FIG. 12) defining non-diametrical chords for the hub 106A. The side edge surfaces 158 of the lugs 131A, 132A of the dispenser 101 of the second embodiment provide additional edge surfaces which further deter an edge portion 301A (FIG. 8) of a hole in a backcard from lapping over the lugs 131A, 132A and thereafter separating from the dispenser 101.

The dispensers of the present invention may be constructed using high speed assembly machinery. The high speeds of such machinery create disorder along the assembly line by causing vibrations and other forces which tend to disperse the locations of the dispensers. For example, during some assembly operations the dispensers are located side to side as shown in FIG. 14. During such operations the dispensers may be subject to compressive forces in the direction of the axis of the tubular hub 206. Such compressive forces tend to cause one or more dispensers to "pop-up" or rise above the other dispensers on the assembly line. A random distribution of dispensers along the assembly line is undesirable as it may lead to assembly line failure such as jamming. However, dispensers 200 according to a third embodiment of the present invention provide means for controlling the relative positions of the dispensers and for preventing a dispenser from "popping-up" relative to the remaining dispensers due to compressive forces. This feature assists in preventing assembly failure in high speed assembly machinery.

FIGS. 13 and 14 illustrate a third embodiment of dispenser according to the present invention generally designated by the reference numeral 200.

Like the dispensers 100, 101 the dispenser 200 comprises a housing 202 including a side wall 204, and a tubular hub 206 having a longitudinal axis A defining an axial direction, cylindrical inner 205 and outer 207 surfaces, and a first end 208 fixed to the side wall 204. At the junction between the inner surface 205 of the hub 206 and the side wall 204 is a convex arcuate portion 199 for affording a "nesting" feature later to be explained in greater detail.

The hub 206 comprises a continuous base portion 212 joined to the side wall 204 by being integral therewith, first 216 and second 218 opposed arcuate guide portions projecting axially from the continuous base portion 212, and first 220 and second 222 opposed arcuate flexible portions having a distal end 223 remote from the continuous base portion 212. The first 220 and second 222 flexible portions project axially from the continuous base portion 212 between the guide portions 216, 218 and have axially extending side surfaces 219, 221, 225, 229 defining non-diametrical chords C5 and C6 for the hub 206 (FIG. 13).

Similar to the dispensers 100 and 101, there is a retaining lug 231, 232 at the distal end 223 of each of the flexible portions 220, 222 and the retaining lugs 231, 232 have a remote end 235 spaced axially from the flexible portions 220, 222. The retaining lugs 231, 232 also each have a first retaining surface 240, 242 adjacent the distal end of the flexible portion 220, 222 which projects radially outward of the flexible portion 220, 222 and have outer edges 275, 277 and a second retaining surface 241, 243 also adjacent the distal end of the flexible portion 220, 222, which projects radially inward of the flexible portion 220, 222 and have inner edges 274, 276.

Like the dispenser 100, the dispenser 200 includes retaining lugs each having four camming surfaces 261, 262, 263, 264; 265, 266, 267, 268 with first and second camming surfaces 261, 262; 265, 266 diverging from the remote end 235 of the retaining lugs 231, 232 toward the outer edges 275, 277 of the first retaining surfaces 240, 242 and the inner edges 274, 276 of the second retaining surfaces 241, 243 of the retaining lugs 231, 232 and with third and fourth camming surfaces 263, 267; 264, 268 diverging from the remote end 235 of the retaining lugs 231, 232 toward the axially extending side surfaces 219, 221, 225, 229 defining the non-diametrical chord C5, C6 (FIG. 13) for the hub 206. However, instead of the relatively planar camming surfaces 162, 166 of the dispenser 100, according to the third embodiment of the present invention, the retaining lugs 231, 232 have arcuate concave camming surfaces 262, 266 at their radially outermost portion which afford engagement with the arcuate, rounded convex surface 299 of the first end 208 of the tubular hub 206. Moreover, the dispenser 101 shown in FIGS. 5 and 6 could have surfaces 151, 154 replaced with arcuate concave surfaces with a diameter between middle portions of the surfaces 151, 154 generally equal to the diameter between middle portions of the arcuate rounded convex surface 199A to form a dispenser according to the third embodiment of the present invention.

In each of the first, second and third embodiments the inner surface 105, 105A, 205 of the tubular hub 106, 106A, 206 opens through a planar outer surface portion of the sidewall 104, 104A, 204 to define a through opening T in the sidewall 104, 104A, 204. At the juncture between the first end 108, 108A, 208 of the inner surface of the hub 106, 106A, 206 and the outer surface of the sidewall 104, 104A, 204 is a convex arcuate portion 199, 199A, 299, and in dispensers 200 according to the third embodiment, the convex arcuate portion 299 is adapted to nest against opposite portions of the first arcuate concave camming surfaces 262, 266 of a second refillable tape dispenser to maintain the relative positions of the tape dispensers, for example, as they traverse an assembly line L or during shipment of the dispensers.

FIG. 14 shows a pair of dispensers 200 according to the third embodiment of the present invention "meshed" or "nested" as they traverse an assembly line L. The frictional engagement between the first arcuate concave camming surfaces 262, 266 and the convex arcuate portion 299 deters displacement of the dispensers relative to one another. As shown in FIG. 14, the diameter D of a middle portion of the convex arcuate surface 299 is approximately the same as the diameter D between middle portions of the first arcuate concave camming surfaces 262, 266. The arcuate geometry of the convex surfaces 299 and camming surfaces 262, 266 provides additional surface area for frictional, abutting engagement between the complementary concave and convex surfaces to retain the camming surfaces 262, 266 in engagement with the convex surface 299.

Figure 9:
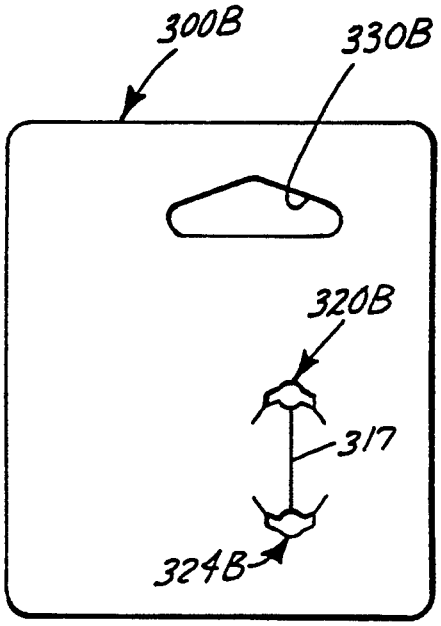
FIG. 9 is a side view of a second embodiment of backcard for a dispenser according to the present invention.
Figure 8:
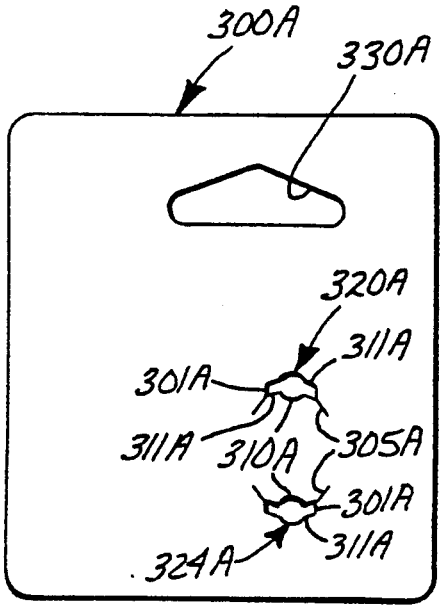
FIG. 8 is a side view of a first embodiment of backcard for a dispenser according to the present invention.
Figure 10:
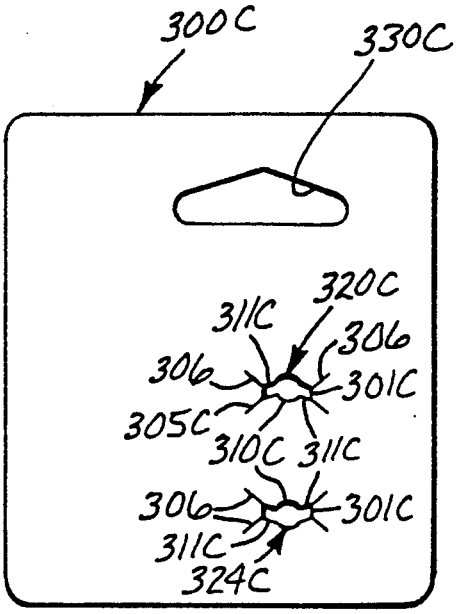
FIG. 10 is a side view of a third embodiment of backcard for a dispenser according to the present invention.

FIGS. 8-10 show three embodiments of backcards according to the present invention which are coupled to the dispensers 100, 101, 200. The backcards 300A, 300B, 300C each have a hanging hole 330A, 330B, 330C for hanging a backcard 300A, 300B, 300C coupled to a dispenser 100, 101, 200 on a commercial display or rack. The backcards 300A, 300B, 300C may also be used to display miscellaneous indicia. Each of the backcards 300A, 300B, 300C are described in relation to the first embodiment of dispenser 100 but each of the backcards 300A, 300B, 300C may alternatively be used with each of the dispensers 100, 101, 200.

FIG. 8 illustrates a first embodiment of backcard according to the present invention generally designated by the reference numeral 300A.

The backcard 300A has surfaces defining first and second chevron-shaped openings 320A, 324A, each of the openings including parallel end surfaces 301A, and two pairs of opposite parallel surfaces 311A disposed at obtuse angles with respect to each other and defining outer portions of the openings 320A, 324A. The pairs of opposite parallel surfaces 311A are joined to each other by concave arcuate surface portions defining a generally circular central portion 310A of the openings 320A, 324A.

Figure 3:
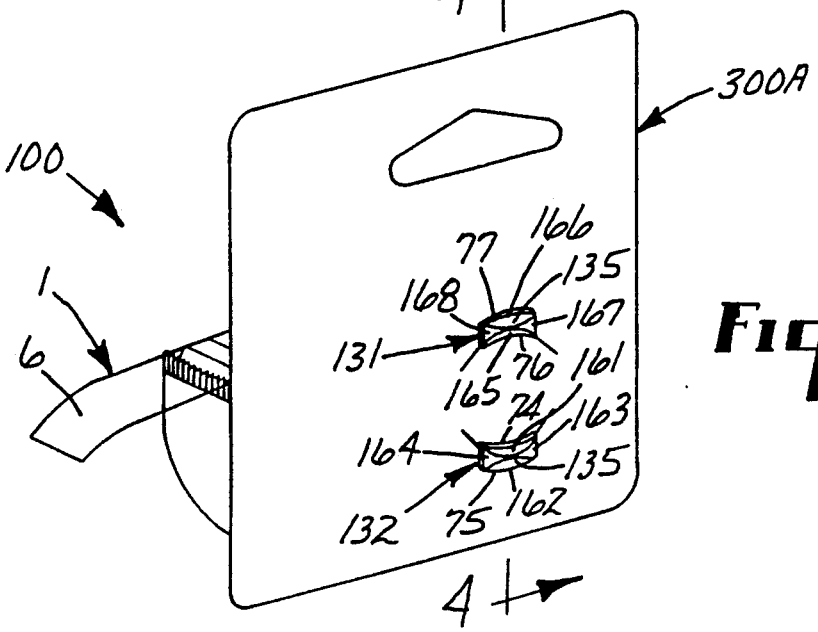
FIG. 3 is a perspective view of a first embodiment of dispenser according to the present invention together with a backcard coupled thereto.
Figure 2A:
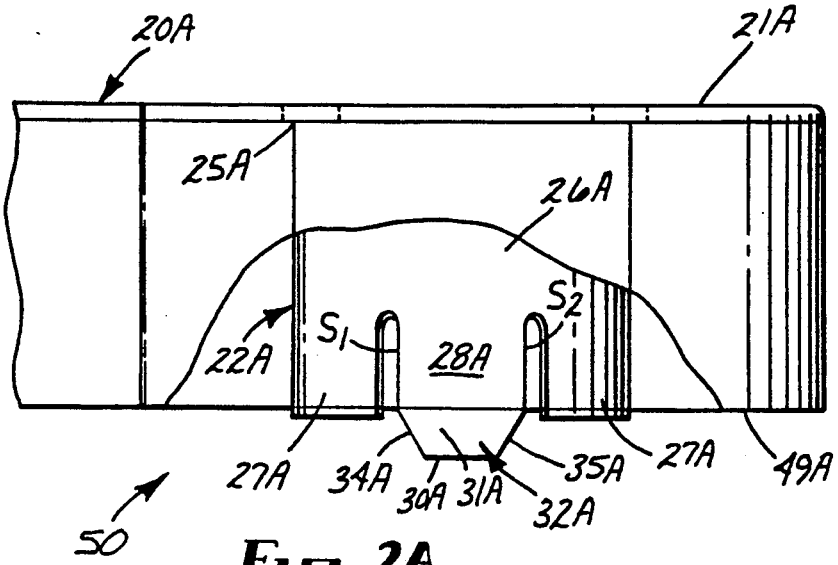
Fig. 2A PRIOR ART
FIG. 2A is an enlarged fragmentary top view of the dispenser shown in FIG. 2 with portions broken away to show detail.

The backcard 300A is adapted to be disposed around the distal ends 123 of the first and second flexible portions 120, 122 as shown in FIGS. 3 and 5. When the backcard 300A is joined to a dispenser 100, the opposite parallel surfaces 311A are disposed adjacent the inner 105 and outer 107 surfaces of the flexible portions 120, 122 and extend from the central portion 310A to the parallel end surfaces 301A.

The backcard 300A further comprises slits 305A which are disposed approximately along a line which bisects the included angle between an opposite parallel surface 311A and an end surface 301A. The slits 305A afford flexing of the backcard 300A to facilitate passage of the retaining lugs 131, 132 from one side of the backcard to the other through the chevron-shaped openings 320A, 324A during the assembly of the backcard/dispenser combination. The slits 305A provide means for quick and efficient assembly of the backcard/dispenser combination. The combination of any one of the dispensers 100, 101, 200 and backcard 300A comprises a combination with an efficient holding means for the backcard that is readily adapted to be manufactured quickly on high speed assembly machinery.

FIG. 9 illustrates a second embodiment of backcard according to the present invention generally designated by the reference numeral 300B which has many parts that are essentially the same as the parts of the backcard 300A and which have been identified by the same reference numeral to which the suffix "A" has been replaced by the suffix "B". The backcard 300B is identical to the backcard 300A except that in the backcard 300B, there is a slit 317 extending between the chevron-shaped openings 320B, 324B. The slit 317 affords extra flexing of the backcard 300B to further provide means for speedy assembly of the dispenser/backcard combination.

FIG. 10 illustrates a third embodiment of backcard according to the present invention generally designated by the reference numeral 300C which has many parts that are essentially the same as the parts of the backcard 300A and which have been identified by the same reference numeral to which the suffix "A" has been replaced by the suffix "B". The backcard 300C is identical to the backcard 300A except that in the backcard 300C, there are two additional slits 306 for each of the chevron-shaped openings 320C, 324C.

Like the slits 305A, the slits 306 are disposed approximately along a line which bisects the included angle between an opposite parallel surface 311C and an end surface 301C. The slits 306 afford flexing of the backcard 300C to facilitate passage of the retaining lugs 131, 132 from one side of the backcard 300C to the other through the chevron-shaped openings 320C, 324C during assembly of the backcard/dispenser combination.

Unlike the backcards 300A and 300B, the backcard 300C comprises four slits for each of the chevron-shaped openings 320C, 324C but no slit extending between the chevron-shaped openings 320C, 324C. The additional slits 306 for each of the apertures 320C, 324C afford added flexing of the backcard 300C to provide speedy assembly of the dispenser/backcard combination, and to afford a lower failure rate when backcards are joined to a dispenser.

The present invention may also be expressed as a combination of the novel hub features of the dispensers 100, 101, 200 with the backcards 300A, 300B, 300C.

Using the first embodiment of backcard as illustrative, the chevron-shaped holes 320A, 324A of the backcards each include a relatively large circular central portion 310A proximate a middle portion of the chevron-shaped openings 320A, 324A for passage of the relatively sharp middle portion of the lugs 131, 132 during assembly, and have a narrower width along parallel surfaces 311A. The narrow portions of the chevron-shaped openings 320A, 324A near the ends 301A provide additional surface area to contact the first and second retaining surfaces 140, 141, 142, 143 and provide a narrower width in the holes adjacent the end E of lugs 131, 132 to thereby prevent the backcard from lapping over the lugs 131, 132. The relative large circular central portions 310A afford efficient assembly of the backcard/dispenser combination as the holes 310A align the center of the chevron-shaped openings 320A, 324A with the center of the retaining lugs 131, 132 and allow the retaining lugs 131, 132 to efficiently pierce the chevron-shaped openings 320A, 324A without jamming the machinery used to join the backcard/dispenser combination.

The dispensers 100, 101, 200 may be manufactured using molding processes. The windows W1, W2, W3 shown in FIGS. 4, 6, 13 and 14 are required in some molds in order to form the lugs 131, 132 but are not necessary for the present invention. The windows W1, W2, W3 are sometimes required since it is difficult to mold the size and shape of the lugs 131, 132. The dispensers 100, 101, 200, however, may be manufactured using molds which do not require the windows W1, W2, W3 to form the lugs 131, 132 and thus, the windows W1, W2, W3 may be omitted from the present invention.

FIG. 14 illustrates a pair of dispensers 200 according to a third embodiment of the present invention which include a window W3. As shown in FIG. 14, as the dispensers 200 travel axially along an assembly line L, the retaining lugs 231, 232, are located adjacent the windows W3. If the lugs 231, 232 of a dispenser 200 become entangled within the windows W3 of an adjacent dispenser 200, a failure such as a defective dispenser or a jammed assembly line tends to occur. Thus, in the preferred embodiment of the present invention, the windows W1, W2, W3 are omitted. Moreover, when the windows W3 are present, the arcuate camming surfaces 262, 266 are especially desirable as they tend to prevent the lugs 231, 232 from becoming entangled with the windows W3 of an adjacent dispenser 200.

FIGS. 15 through 18 illustrate a fourth embodiment of dispenser according to the present invention generally designated by the reference numeral 400. FIG. 19 illustrates a backcard which is particularly suitable for use with the dispenser 400, generally designated by the reference number 370. The backcard 370 is generally identical to the backcard 300A shown in FIG. 8 except that the backcard 370 includes a polygonal notch 371 that is adapted to position the backcard 370 to restrict interference between the backcard 370 and the teeth of the dispenser 400.

FIG. 16 illustrates the backcard 370 disposed around the distal ends of first 420 and second 422 opposed arcuate flexible portions of the dispenser 400. The backcard 370 has opposite major surfaces 372, 373 and edge surfaces between the major surfaces 372, 373 defining first and second chevron-shaped openings 374 between the major surfaces 372, 373. The edge surfaces define each of the openings and include generally parallel end surface portions 375, two pairs of opposite parallel surface portions 376 disposed at obtuse angles with respect to each other and defining outer portions of the openings 374, and concave arcuate surface portions 377 joining the pairs of opposite parallel surface portions 376 to each other and defining generally circular central portions of the openings 374.

Optionally the backcard 370 may comprise slits 378 which are disposed approximately along a line which bisects the included angle between an opposite parallel surface portions 376 and the end surface portions 375 of the chevron-shaped openings 374 to afford flexing of the backcard 370 to facilitate passage of the retaining lugs 431 and 432 from one side of the backcard 370 to the other through the chevron-shaped openings 374.

The dispenser 400 comprises a housing 402 including a side wall 404, and a hub 406. Like the previously mentioned dispensers 100, 101 and 200, the hub 406 has a longitudinal axis defining an axial direction, inner 405 and outer 407 surfaces, and a first end 408 fixed to the side wall 404. The hub 406 also comprises first 420 and second 422 opposed flexible portions having distal ends 423 remote from the side wall 404. The first 420 and second 422 opposed flexible portions project axially from the side wall 404. A retaining lug 431 and 432 is located at the distal end 423 of each of the flexible portions 420 and 422.

Unlike the previously mentioned embodiments of the present invention, the dispenser 400 according to the fourth embodiment comprises ribs 450 located at the distal end 423 of each of the flexible portions 420 and 422. The ribs 450 project radially outward of the flexible portions 420 and 422 and have axially extending arcuate bearing surfaces 452. The arcuate surface portions 377 of the backcard 370 are positioned generally adjacent the bearing surfaces 452 of the ribs 450 so that the surface area of the flexible portions 420, 422 which impacts the surfaces defining the chevron-shaped openings 374 is increased to thereby restrict rotation of and damage to the backcard 370 particularly at the intersection between an end surface portion 375 and an opposite parallel surface portion 376. It is believed that increasing the surface area reduces the unit pressure on the surfaces on the openings 374. This feature provides a tape dispenser with an increased capacity to retain a backcard, which resists rotation of the backcard relative to the dispenser, and which resists damage from impulsive impacts such as when the backcard and dispenser are dropped.

Optionally, the ribs 450 may be fixed to the retaining lugs 431 and 432. Also optionally, the ribs 450 may include ramp surfaces 455 opposite the retaining lug disposed at an angle adapted to cam the flexible portions 420 and 422 radially inwardly when the core of a roll of tape (see FIG. 4 or 6) is removed from the hub 406. This feature provides for convenient and efficient removal of a core of a roll of tape from the hub 406.

The present invention has now been described with reference to several embodiments thereof. It will be apparent to those skilled in the art that many changes or additions can be made in the embodiments described without departing from the scope of the present invention. For example, the guide portions 116, 118 may be shortened as shown in FIGS. 4 and 14 or lengthened, as shown in FIG. 6. The guide portions 216, 218 may be completely omitted from the hub 206 leaving only the continuous base portion 212 and the flexible portions 220, 222 in order to decrease the overall weight of the dispenser 200. The related grooves G1, G2, G3 may also be shortened or lengthened to control the flexibility and the spring constant of the flexible portions. Also, the backcards of the present invention may be a variety of shapes including but not limited to rectangular or square shapes with rounded corners. Thus, the scope of the present invention should not be limited to the structures described in this application, but only by structures described by the language of the claims and the equivalents of those structures.

What is claimed is:

1. In combination, a roll of tape comprising a core having inner and outer cylindrical surfaces and a through opening defined by the cylindrical inner surface, and a length of pressure sensitive adhesive coated tape wound around said core, and a refillable tape dispenser comprising:

a housing including a side wall, a hub having a longitudinal axis defining an axial direction, inner and outer surfaces, and a first end fixed to said side wall, said hub comprising:

first and second opposed arcuate flexible portions having distal ends remote from said side wall, said first and second opposed arcuate flexible portions projecting axially from said side wall, said flexible portions having axially extending side surfaces, a retaining lug at the distal end of each of said flexible portions, the retaining lugs having remote ends spaced axially from said flexible portions, and ribs at the distal end of each of said flexible portions generally adjacent said retaining lug, which ribs project generally radially outward of said flexible portions and have axially extending arcuate bearing surfaces; and a backcard disposed around said distal ends of said first and second opposed arcuate flexible portions, said backcard having opposite major surfaces and edge surfaces between said major surfaces defining first and second chevron-shaped openings between said major surfaces, said edge surfaces defining each of the openings including generally parallel end surface portions, two pairs of opposite parallel surface portions disposed at obtuse angles with respect to each other and defining outer portions of the openings, and concave arcuate surface portions joining said pairs of opposite parallel surface portions to each other and defining generally circular central portions of the openings, said arcuate surface portions being positioned generally adjacent said bearing surfaces of said ribs so that the surface area of said dispenser which impacts the surfaces defining said chevron-shaped openings is increased to thereby restrict the damage to the backcard particularly at the intersection between an end surface portion and an opposite parallel surface portion.

2. A combination according to claim 1 wherein:

said backcard further comprising slits which are disposed approximately along a line which bisects the included angle between an opposite parallel surface portion and the end surface portion of the chevron-shaped opening to afford flexing of said backcard to facilitate passage of said retaining lug from one major side of said backcard to the other through said chevron-shaped openings.

3. A combination according to claim 1 wherein said ribs are fixed to said retaining lug and include ramp surfaces opposite said retaining lug disposed at an angle adapted to cam the flexible portions radially inwardly when said core of said roll of tape is removed from said hub.

4. In combination, a refillable tape dispenser for a roll of tape comprising:

a housing including a side wall, a tubular hub having a longitudinal axis defining an axial direction, inner and outer surfaces, a first end fixed to said side wall, said hub comprising first and second opposed arcuate flexible portions having distal ends remote from said side wall, said first and second opposed arcuate flexible portions projecting axially from said side wall and having axially extending side surfaces, a retaining lug at the distal end of each of said flexible portions, said retaining lugs having remote ends spaced axially from said flexible portions and having cam surfaces, and ribs at the distal end of each of said flexible portions generally adjacent said retaining lug, which ribs project radially outward of said flexible portions and have axially extending arcuate bearing surfaces; and a backcard disposed around said distal ends of said first and second opposed arcuate flexible portions, said backcard having opposite major surfaces and edge surfaces between said major surfaces defining first and second chevron-shaped openings between said major surfaces, said edge surfaces defining each of the openings including generally parallel end surface portions, two pairs of opposite parallel surface portions disposed at obtuse angles with respect to each other and defining outer portions of the openings, and concave arcuate surface portions joining said pairs of opposite parallel surface portions to each other and defining generally circular central portions of the openings, said arcuate surface portions being positioned generally adjacent said bearing surfaces of said ribs so that the surface area of said dispenser which impacts the surfaces defining said chevron-shaped openings is increased to thereby restrict the damage to the backcard particularly at the intersection between an end surface portion and an opposite parallel surface portion.

5. A combination according to claim 4 wherein:

said backcard further comprising slits which are disposed approximately along a line which bisects the included angle between an opposite parallel surface portion and an end surface portion of the chevron-shaped opening to afford flexing of said backcard to facilitate passage of said retaining lugs from one side of said backcard to the other through said chevron-shaped openings.

6. A combination according to claim 4 wherein said ribs are fixed to said retaining lug and include ramp surfaces opposite said retaining lug disposed at an acute angle relative to said axis of said hub.

7. A refillable tape dispenser comprising:

a housing including a side wall, and a hub having a longitudinal axis defining an axial direction, inner and outer surfaces, a first end fixed to said side wall, said hub comprising:

first and second opposed flexible portions having distal ends remote from said side wall, said first and second opposed flexible portions projecting axially from said side wall, said flexible portions having axially extending side surfaces, a retaining lug at the distal end of each of said flexible portions, the retaining lugs having remote ends spaced axially from said flexible portions, and ribs at the distal end of each of said flexible portions which project radially outward of said flexible portions and have axially extending arcuate bearing surfaces.

8. A refillable tape dispenser according to claim 7 wherein said ribs are fixed to said retaining lug and include ramp surfaces opposite said retaining lug disposed at an acute angle relative to said axis of said hub.

* * * * *